United States Patent [19]

Miyake et al.

[11] 4,053,114

[45] Oct. 11, 1977

[54] METHOD AND APPARATUS FOR COUNTING YARN-SPLICING OPERATIONS OF SPINDLES IN AUTOMATIC WINDING MACHINE

[75] Inventors: Takao Miyake, Neyagawa; Katsue Koashi, Toyonaka, both of Japan

[73] Assignee: Kurashiki Boseki Kabushiki Kaisha, Japan

[21] Appl. No.: 733,190

[22] Filed: Oct. 18, 1976

[30] Foreign Application Priority Data

Oct. 20, 1975 Japan ..... 50-126592

[51] Int. Cl.[2] ..... B65H 63/00; B65H 69/02; B65H 69/04

[52] U.S. Cl. ..... 242/36; 242/35.5 R; 242/35.6 R; 242/37 R

[58] Field of Search ..... 242/36, 35.5 R, 35.6 R, 242/37 R

[56] References Cited

U.S. PATENT DOCUMENTS

| | | | |
|---|---|---|---|
| 2,961,178 | 11/1960 | Chambley | 242/35.6 R |
| 3,151,819 | 10/1964 | Hodgdon | 242/37 R X |
| 3,834,634 | 9/1974 | Havlas | 242/36 X |
| 3,939,633 | 2/1976 | Lossa | 242/35.6 R |

*Primary Examiner*—Edward J. McCarthy
*Attorney, Agent, or Firm*—Wenderoth, Lind & Ponack

[57] ABSTRACT

A method and apparatus for counting yarn splicing operations for each of the spindles in an automatic winding machine provided with a plurality of winding spindles and an automatic knotting machine and in which relative motion of said spindles and said knotting machine causes the knotting machine and successive spindles to be adjacent each other for carrying out a yarn splicing operation when necessary. A pulse signal is generated each time the knotting machine and a spindle are adjacent each other during the relative motion of the knotting machine and the spindles, the pulse being of relatively short duration when the knotting machine is adjacent a spindle for a time insufficient to carry out a splicing operation. The apparatus discriminates between the long and short duration pulses for each spindle, and the long duration pulses for each spindle are counted as an indication of the occurrances of a splicing operation for that spindle.

3 Claims, 4 Drawing Figures

METHOD AND APPARATUS FOR COUNTING YARN-SPLICING OPERATIONS OF SPINDLES IN AUTOMATIC WINDING MACHINE

The present invention relates to a method and an apparatus for counting, spindle by spindle, the number of yarn splicing operations, that is, yarn-splicing frequencies, for spindles in an automatic winding machine provided with an automatic knotting machine in order to detect quickly abnormal yarns and spindles requiring maintenance and to analyze the reasons for splicing for each spindle to provide a single-spindle monitoring operation.

Generally, in an automatic winding machine provided with circulating automatic knotting machines, the following various monitoring apparatuses are used to process the information about each spindle;

1. a system in which a spindle, the yarn to which is broken, is detected by an impulse receiver or a sensor, and a computer processes the information for each spindle in one section of the machine (for example, 10 spindles), which was obtained through the motion of a linking mechanism secured to each spindle;

2. a system in which the presence of the yarn is detected by a lever contact method, the information about a yarn break for each spindle being punched in a tape, the spindle and machines being identified and recorded for processing by a computer by a batch method;

3. a system in which the yarn break is detected by a limit switch which is in contact with the yarn, the number of the yarn breaks for each spindle being added and displayed by a transmitting apparatus for each spindle for transmitting a number signal and a yarn break signal and which is disposed in a position associated with each spindle; and 4. a system in which the number of the normal yarn splicing operations is detected by each spindle for means of a photoelectric tube and is directly counted, spindle by spindle, by a magnet relay method.

Among the above systems, the information about each spindle obtained by the system (1) applies only to the section (for example, 10 spindles) which was set initially, the information from one machine or a plurality of machines being unavailable collectively and simultaneously, the system (2) can not process the punched tape continuously and simultaneously due to the batch method, the system (3) requires one information processor unit per machine, and the system (4) requires a counting apparatus for each machine.

Thus, the number of the components for the prior art systems is large, which is disadvantageous.

The present invention seeks to remove such various disadvantages as described hereinabove. An object of the present invention is to provide a method and apparatus for counting the number of the yarn-splicing operations and which can process the yarn-splicing information for many spindles quickly and simultaneously without the use of any special components.

According to the present invention, in the yarn splicing system of a winding machine, the occurrance of a yarn splicing operation is detected or judged to have been effected when the knotting machine remains adjacent a spindle for at least a predetermined length of time. The yarn-splicing operations are calculated from the results of the obtained knotting data. The detecting means for checking the existence of the yarn splicing operation can have a very simple construction, such as reed switches, etc. Also, the signals from many winding spindles can be obtained easily from the signals for each winding spindle so that the yarn splicing data can be obtained easily.

Furthermore, according to the present invention, the yarn splicing information for the respective winding spindles is coded in accordance with a number corresponding to the respective winding spindle, the coded information being sent to a computer in a multiplexing manner and for each unit in a plurality of sections to perform a counting and processing operation. Accordingly, an inexpensive and convenient counting apparatus for counting yarn splicing operations and which can process the yarn splicing information quickly for many winding spindles is provided.

These and other objects and features of the present invention will become apparent from the following description of a preferred embodiment thereof taken together with the attached drawings in which.

Figure 1:
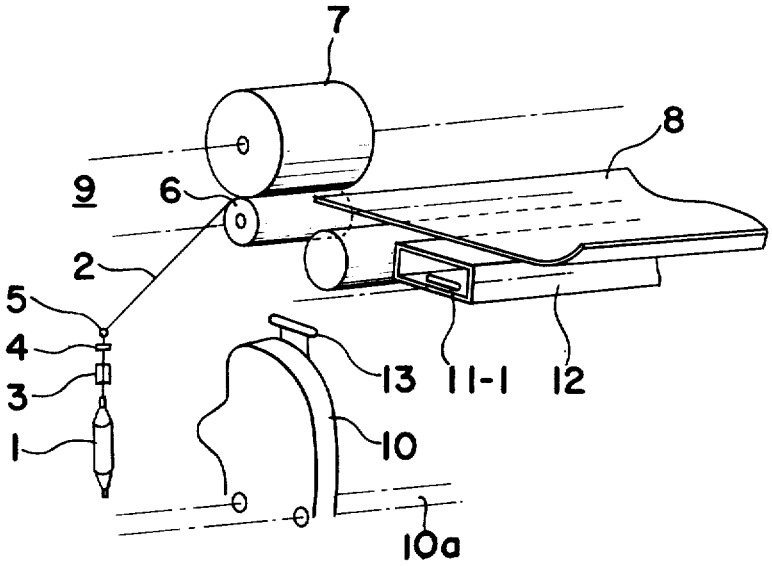
FIG. 1 is a schematic perspective view showing the essential parts associated with one winding spindle of an automatic winding machine to which the present invention is applied.

Referring now to FIG. 1, there are shown the essential parts of one winding head in a conventional known automatic winding machine, in which the yarn 2 unwound from the spun yarn 1 is wound up on a cheese 7 by means of a driving drum 6, through a unwinding controller 3, a tension regulator 4 and a slub catcher or a yarn clearer 5 in a known manner and the fully-wound cheese is adapted to be placed on a deposit shelf 8, and one knotting machine 10*a* of known type which is always driven to pass along the spindles of one group of said winding spindles and to occasionally stop and splice the yarn of the respective winding spindle which has been cut or broken for one reason or another.

Figure 2:
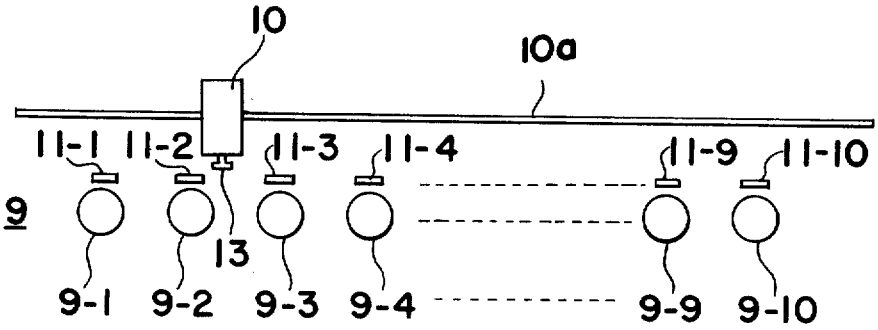
FIG. 2 is a diagrammatic view showing for one section of the winding machine, the construction of one embodiment in accordance with the present invention.

As shown in FIG. 2, one arrangement in the winding machine has, for example, 10 spindles 9 disposed on a straight line at regular intervals, five sets of said spindles 9 being arranged at one place and constituting one unit of the automatic winding machine. The knotting machine 10 is driven so as to reciprocate at a given speed along a travelling track 10*a* for said each section of spindles 9-1, 9-2, . . . 9-10. Upon detecting that a winding spindle requires a yarn splicing operation by means of a detecting lever not shown in the drawings, the knotting machine 10 stops to perform the yarn splicing operation. After the yarn splicing is completed, the automatic knotting machine is re-started to resume its movement and splice the yarn of other winding spindles.

Reed switches 11-1, 11-2, . . . 11-10 are disposed adjacent corresponding winding spindles 9-1, . . . 9-10, respectively. As shown at 11-1 in FIG. 1, reed switches 11-1, 11-2, . . . 11-10 are disposed inside a duct 12 of non-magnetic material secured under the deposit shelf 8.

A magnet 13 is secured on the top portion of the automatic knotting machine 10 at a position right under the duct 12 and in a location corresponding to the line along which the group of reed switches lies.

Approximately 10 mm is provided between the magnet 13 and the reed switches 11-1, 11-2, . . . 11-10, the duct 12 being adapted to protect the group of reed switches secured inside the duct from impacts and to prevent dust etc., from accumulating thereon.

The magnet 13 moves together with the knotting machine 10 and each reed switch 11 makes and breaks each time the magnet 13 passes. The time period for which the reed switch is kept closed is approximately 5 seconds when the knotting machine 10 stops and carries out a yarn splicing operation, and is approximately 0.5 second when the knotting machine merely passes a spindle without stopping to carry out a yarn splicing operation. Accordingly, according to the present invention, the occurrance of a yarn splicing operation is detected by discrimination between the different time periods for which the reed switch is kept closed. On the other hand, the time period during which the reed switch is kept open can likewise be detected if the reed switch is the type which is open during operation.

Figure 3:
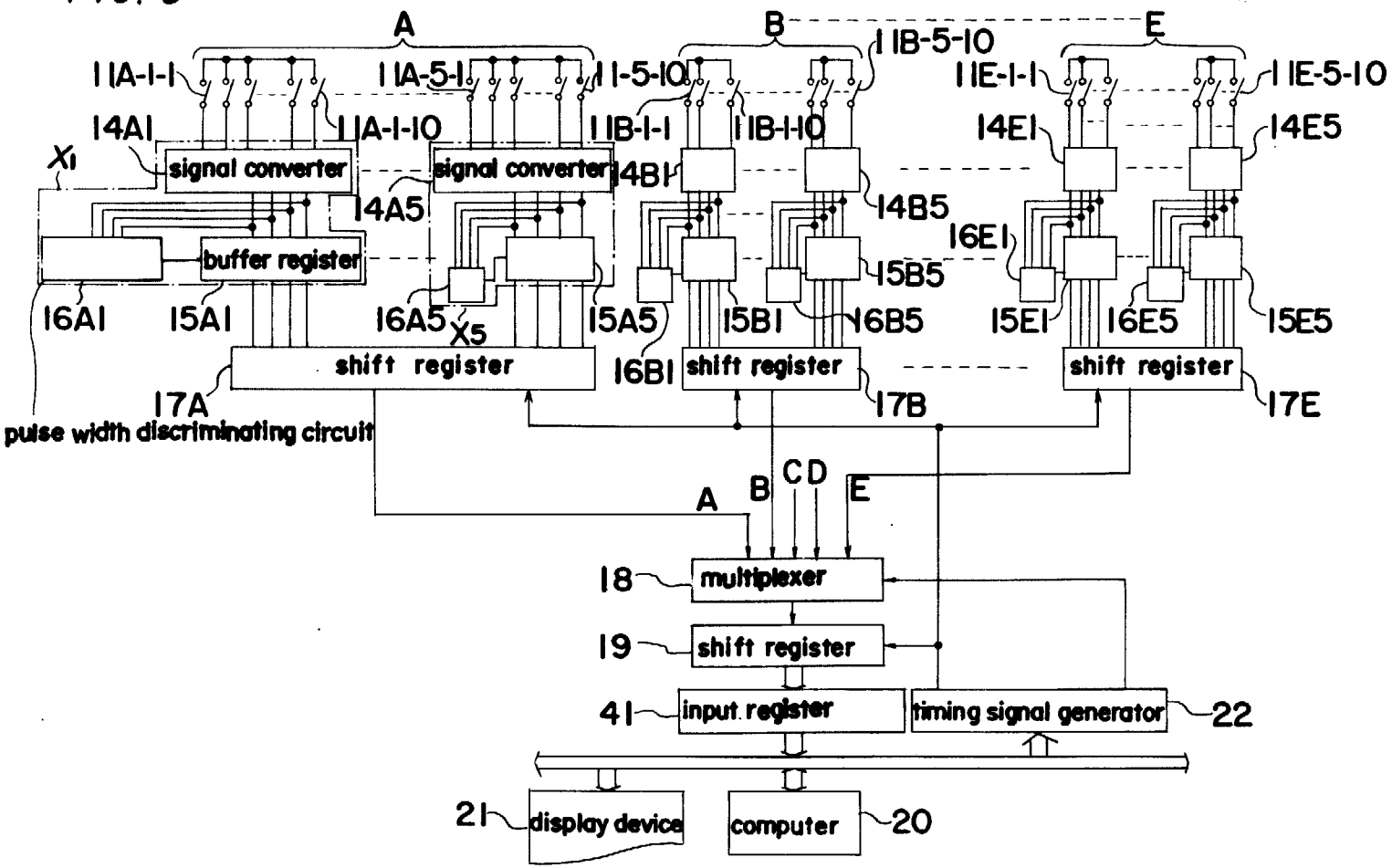
FIG. 3 is a block diagram of a data processing device in accordance with the present invention.

Referring now to FIG. 3 showing a circuit for collecting and processing the number of the yarn splicing operations, reference characters A, B . . . E designate five units of the winding machine. As described hereinabove, a set of 10 winding spindles in one group constitute one section, five sections constituting one unit of the winding machine.

11A-1-1, 11A-1-2, . . . 11A-1-10 knotting machine detecting reed switches in a first section of the A unit of the winding machine, the suffix numbers 1, 2, . . . 10 for each reed switch indicating the number of the winding spindles as shown in FIG. 2, respectively. The reference characters are provided, in the same form, for the other reed switches to be described later.

The terminals on one side of each of the reed switches 11A-1-1, 11A-1-2, . . . 11A-1-10 are connected in common, while the other terminals are individually connected to a signal converter 14A1. When the signal converter 14A1 receives the signal from any one of the reed switches, it generates a binary coded dicimal code signal (hereinafter referred to as a BCD code signal) corresponding to the number of the reed switch.

The output code signal of the signal converter 14A1 is applied to a buffer register 15A1. The buffer register 15A1 receives the output BCD code signal of the signal converter 14A1 when a pulse width discriminating circuit 16A1 connected to the signal converter 14A1 and the buffer register 15A1 detects from the BCD code signal that the knotting machine 10 has remained at a fixed position for a time longer than a predetermined time period to effect a yarn splicing operation.

A parallel-to-serial shift register 17A converts the four-bit parallel BCD code signal, which is applied from the buffer register 15A1, into a serial BCD code signal as an output.

Every reed switch in the second, third, fourth and fifth sections in the A unit of the winding machine is connected to a signal converter for the section, e.g. the switches for the fifth section, 11A-5-1 to 11A-5-10 are connected to a signal converter 14A5 as described in connection with the first section. The parallel code signals of the signal converters such as the converter 14A5 are applied to the shift register 17A through corresponding buffer registers, e.g. buffer register 15A5.

A data processing circuit having the same parts as the unit A as described hereinabove is provided for the units B, C, D and E.

Namely, referring to FIG. 3, 11B-1-1 to 11E-5-10 are reed switches for the respective winding spindles in the sections in units B–E; 14B1 to 14E5 are the signal converters, respectively, provided in each section; 15B1 to 15E5 are the buffer registers, respectively; 16B1 to 16E5 are the pulse width discriminating circuits and 17B to 17E being parallel-to serial converter type of shift registers, respectively.

In the above description, the letter of the reference character of each component shows which unit of the winding machine the component is in, the numeral after the letter corresponding to the section number of each unit of the machine, and the suffix numeral in the reference character for the reed switches showing the number of the corresponding winding spindle in each section.

Still referring to FIG. 3, there is provided a a multiplexer 18 which extracts, in a multiplexing manner in accordance with a selected unit of the winding machine, the data which is set in each shift register 17A, 17B, . . . 17E, a serial-to-parallel converter type of register 19 which converts a series code signal coming from the data selector into the parallel one, a computer 20 which processes the output of the register 19, a display device 21 and timing signal generator 22.

Figure 4:
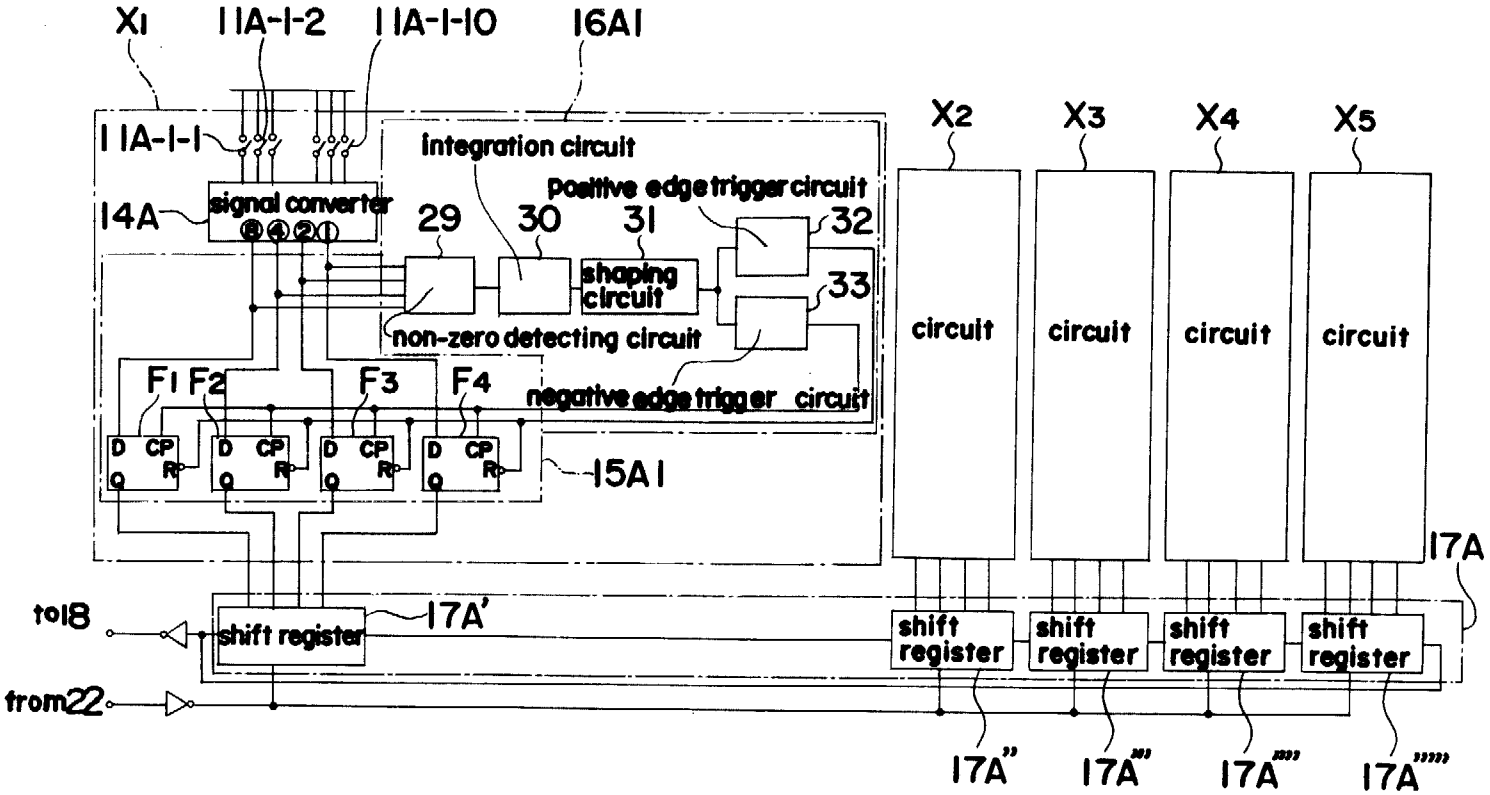
FIG. 4 is a block diagram showing the essential components of FIG. 3.

FIG. 4 is a detailed diagram showing the details of the circuit from the reed switches 11A-1-1, etc., to the register 17A in FIG. 3. The same reference characters are provided for the corresponding components throughout the diagrams. The circuits X2, X3, . . . X5 which have same function as the circuit surrounded by one dot-chain line X1, respectively, are provided in the second, third, . . . fifth sections.

The buffer register 15A1 is composed of D-type flip-flops F1, F2, F3 and F4.

The pulse width discriminating circuit 16A1 comprises a non-zero detecting circuit 29 which receives each output from the signal converter 14A1, a leading edge trigger circuit 33 which detects the leading edge of the square wave output of an integration circuit 30 and a shaping circuit 31, and a trailing edge trigger circuit 32 which detects the trailing edge of the output of the shaping circuit.

The time constant of the integration circuit 30 is set at, for example, approximately three seconds. The time constant is set at a value longer than a time, for example about 0.5 second, required for the knotting machine 10 to supply pass each winding spindle without carrying out a yarn splicing operation (hereinafter this condition is referred to as a normal condition), and shorter than a time, for example about 5 seconds and carry out a yarn splicing operation for the knotting machine to remain at one location (hereinafter this condition is referred to as a yarn splicing condition.

As the knotting machine 10 in the first section of the A unit of winding machine sequentially passes, under the normal condition, the winding spindle 9-1, 9-2, . . . 9-10, the reed switches 11-1, 11-2, . . . 11-10 sequentially close and open again in a short time by the action of the magnet 13 disposed on the knotting machine. When a reed switch closes, the signal converter 14A1 converts a reed switch member into a BCD code signal for the closed reed switch which is in the form of outputs "0" and "1" at the terminals ①, ②, ④ and ⑧.

Assuming that the knotting machine 10 passes the winding spindle 9-3 under normal condition and the reed switch 11A-1-3 closes, BCD code signal "0011" is produced at the output terminal of the signal converter 14A1. The output is applied to the D input terminal of flip-flops F1 to F4 and also to the non-zero detecting circuit 29. Thus, it is detected that the reed switch has operated. Then although the integration circuit 30 starts to integrate, the signal does not reach a threshold level due to the fact that under the normal condition the reed switch is very quickly opened. Accordingly, the leading edge trigger circuit 33 and the trailing edge trigger circuit 32 do not operate, and thus set pulses and reset pulses are not supplied to the flip-flops F1 to F4.

Thus, when the knotting machine 10 passes each winding spindle under the normal condition, and the reed switch for the spindle closes, the outputs from the signal converter 14 are not set in the flip-flops F1 to F4.

When the knotting machine 10 effects a yarn splicing operation at, for example, the winding spindle 9-3, the reed switch 11A-1-3 closes as described before. The output "0011" from the signal converter 14A1 is supplied to the D input terminals of the flip-flops F1 to F4 and also to the non-zero detection circuit 29. It is detected that the reed switch has operated. The integration circuit 30 starts to integrate. The reed switch 11A-1-3 is kept closed for a relatively long time becase it is in to the yarn splicing condition, and the integration value of the integration circuit 30 reaches a given threshold level.

The leading edge trigger pulse of the leading edge trigger circuit 33 is supplied to the clock pulse terminals CP of the flip-flops F1 to F4. The output signal "0011" (decimal 3) from the signal converter 14A1 is written and the signal "0011" is sent to a shift register 17A'.

Upon movement of the knotting machine 10 to another winding spindle after completion of the yarn splicing operation, the reed switch 11A-1-3 opens and the output of the non-zero detection circuit 29 becomes "0". The output of the integration circuit 30 then also becomes "0".

The trailing edge trigger pulse of the trailing edge trigger circuit 32 resets the flip-flops F1 to F4.

It is found from reading the stored code signal "0011" out of a data buffer 15A1 during this period that the yarn splicing operation has been carried out at the third winding spindle of the first section.

By the same operation as described herein-above, the yarn splicing operations in the second to the fifth sections and in each section of each unit B, C, D and E are stored in the flip-flops 15A2 15A3 etc. provided in the respective sections.

Each of the code signals in shift registers 17A', 17A'', . . . 17A''''' for the respective sections connected in series respectively and together constituting shift register 17A is transmitted in series by the timing signal from the timing signal generator 22.

The other units B, C, D and E of the winding machine, the code signals in the shift registers 17B, 17C, . . . 17E are transmitted in the same manner as described hereinabove. The data are sent in series and are applied to the multiplexer 18. The data for each unit of winding machine coming from the multiplexer are selected by the selected machine number code from the timing signal generator 22 in a multiplexing manner.

After the BCD code signal has been set in an input register 41 for the data processing, the code signal is supplied to an address corresponding to the spindle the yarn of which has been spliced by the knotting machine.

As described hereinabove, the knotting machine in each section scans the respective winding spindles repeatedly at a proper number per given time period. Accordingly, when the third winding spindle of the first section in the A unit of the winding machine has a the yarn splicing operation performed thereat, the BCD code signal "0011" is supplied to the computer 20 by the same operation as described hereinabove. The counting is supplied to an address corresponding to the third winding spindle of the first section of the A unit.

The yarn splicing operation for of each winding spindle are counted in the same manner as described hereinabove and the results are displayed on the recording apparatus 21.

The hereinbefore described embodiment is one in which the apparatus of the present invention is applied to an automatic winding machine of a type wherein the winding spindle is in a fixed position and the automatic knotting machine circulates. In the automatic winding machine of the type wherein the automatic knotting machine is in a fixed position and the winding spindle circulates, the reed switches can be installed in a stationary position and a magnet installed on the circulating elements. Therefore, these changes and modifications should be understood as included within the scope of the present invention, unless otherwise they depart therefrom.

What is claimed is:

1. A method for counting yarn splicing operations for each of the spindles in an automatic winding machine provided with a plurality of winding spindles and an automatic knotting machine and in which relative motion of said spindles and said knotting machine causes the knotting machine and successive spindles to be adjacent each other for carrying out a yarn splicing operation when necessary, said method comprising generating a pulse signal each time the knotting machine and a spindle are adjacent each other during the relative motion of the knotting machine and the spindles, the pulse being of relatively short duration when said knotting machine is adjacent a spindle for a time insufficient to carry out a splicing operation and being of relatively long duration when said knotting machine is adjacent a spindle for a time sufficient to carry out a splicng operation, discriminating between said long and short duration pulses for each spindle, and counting the long duration pulses for each spindle as an indication of the occurrances of a splicing operation for that spindle.

2. In an automatic winding machine having a plurality of winding spindles and an automatic knotting machine and in which relative motion of said spindles and said knotting machine causes the knotting machine and successive spindles to come adjacent each other for carrying out a yarn splicing operation when necessary, an apparatus for counting the yarn splicing operations for each of said spindles comprising a yarn-splicing detecting means composed of magnet means secured to the movable one of said knotting machine and said spindles, and reed switch means secured to the fixed one of said knotting machine and said spindles in a position opposite the magnet means and actuated by said magnet means; a signal converter and storing means coupled to said reed switch means for converting the outputs of the reed switch means into code signals corresponding to the respective spindles and storing said code signals; a pulse width discriminating circuit coupled to said signal converter and stopping means for transmitting the code signals therefrom only when the signal from the reed switch means has been continued for longer than a predetermined time period; and a date processing device coupled to said signal converter and storing means for individually registering and counting the numbers of the respective code signals during a predetermined time period.

3. An apparatus as claimed in claim 2 in which said spindles are in a fixed position and said automatic knotting machine moves past said spindles, and said magnet means is a magnet on said automatic knotting machine and said reed switch means is a plurality of reed switches, one associated with each spindle.

* * * * *